US006014994A

United States Patent [19]

Schmidt

[11] Patent Number: 6,014,994

[45] Date of Patent: Jan. 18, 2000

[54] PLANT FOR CLEANING A FILLING PLANT

[75] Inventor: Michael G. Schmidt, Wiesbaden, Germany

[73] Assignee: DiverseyLever, Inc., Plymouth, Mich.

[21] Appl. No.: 09/152,781

[22] Filed: Sep. 14, 1998

[30] Foreign Application Priority Data

Sep. 18, 1997 [DE] Germany ..... 197 41 242 U

[51] Int. Cl.[7] ..... B65B 1/04

[52] U.S. Cl. ..... 141/89; 141/91; 134/99.2; 134/170

[58] Field of Search ..... 141/89, 85, 91, 141/92; 134/170, 169 R, 99.2, 58 R

[56] References Cited

U.S. PATENT DOCUMENTS

| | | | |
|---|---|---|---|
| 3,945,411 | 3/1976 | Skoli et al. | 141/91 |
| 4,501,622 | 2/1985 | Marchadour | 134/18 |
| 5,329,950 | 7/1994 | Barinas . | |
| 5,896,899 | 4/1999 | Schmitz | 141/92 |
| 5,941,290 | 8/1999 | Vaughn, Jr. | 141/90 |

FOREIGN PATENT DOCUMENTS

| | | |
|---|---|---|
| 162 968 | 12/1985 | European Pat. Off. . |
| 408 851 | 1/1991 | European Pat. Off. . |
| 94 04 610 | 5/1994 | Germany . |
| 44 34 407 | 3/1996 | Germany . |
| 198 08 357 | 9/1996 | Germany . |
| 96/28263 | 9/1996 | WIPO . |

*Primary Examiner*—Henry J. Recla
*Assistant Examiner*—Huyen Le

[57] ABSTRACT

The operation of filling plants for filling drinks or other foods is subject to stringent regulations under the law on foodstuffs. In this connection, an essential aspect is the cleanness of the filling plant, which consists of a filler and a conveyor. To clean a filling plant, it is known to provide four separate cleaning systems with four separate supply stations and control systems as well as line systems.

The invention provides, for all partial cleaning systems in a common central cleaning circuit (**40*a*, 57), a common supply station (10) comprising the components fresh water container (12**)

storage containers (13–16)

heating station (29)

dosing station (27), which can selectively be connected to or disconnected from the cleaning circuit by means of valves and rotary valve flaps, as well as a programme control system (11) as well as a common partial line system.

10 Claims, 11 Drawing Sheets

PLANT FOR CLEANING A FILLING PLANT

FIELD OF THE INVENTION

The invention relates to a plant for cleaning a filling plant having a filler and conveyor, which plant comprises a CIP cleaning system for the filler and the conveyor as well as a filler external cleaning system and a hot water flooding system.

BACKGROUND OF THE INVENTION

The operation of filling plants for filling drinks, such as mineral water, juices or beer, or foods into containers such as bottles, beer barrels or the like, is subject to stringent regulations under the law on foodstuffs. In this connection, an essential aspect is the cleanness of the plant and of the containers. Where filling takes place into reusable containers, e.g. into already used returnable drinks bottles, these must be intensively cleaned. Appropriate washing devices are commercially available in a multiplicity of designs, and are not affected by the present invention.

Likewise, at specified intervals, in particular after completion of a filling period, it is necessary to clean most intensively the filling plant, namely the filler from which the containers are filled, and specifically from the inside as well as from the outside, as well as the conveying device for the containers to and from the filler, which device is also designated as a conveyor. In this case, these cleaning operations are carried out in or on the filling plant itself, without there being any requirement to undertake noteworthy alterations thereof for the purposes of cleaning. In this case, the cleaning solutions, including rinsing solutions, are moved past the surfaces to be cleaned by means of pumps, or are sprayed on via suitable spray units (heads). This type of cleaning has become known as CIP cleaning (cleaning in place).

Accordingly, in terms of plant engineering, filling plants are provided with the devices necessary for the cleaning operations, which devices are an integral component of the filling plant.

Parts of such CIP cleaning plants are described, for example, in DE 195 08 357 A1, DE 44 34 407 A1 and in general terms in the handbook of CIP cleaning published by the applicant.

According to the prior art, a filling plant typically possesses four cleaning systems in four different parts of the plant, namely a filler CIP plant for the internal cleaning of the filler conveyor CIP plant for cleaning the conveying device, on which the containers are conveyed to and from the filling station filler external cleaning for cleaning a major part of the external surfaces of the filler, and a hot water flooding for cleaning specific parts of the filler exterior using hot water.

Typically, CIP systems consist of:

fresh water lead containers with the function of mains water separation and to make sufficient fresh water available for fresh water rinsing. In addition, in the case of closed cleaning systems they serve as stretch and venting containers, storage containers, where cleaning fluid or rinsing water is stored for the purpose of reuse, a heating station to heat the cleaning solutions and to generate hot water, typically in the form of a concentrating tube heat exchanger heated by means of steam or hot water, a dosing station with dosing pumps to dose the respective cleaning solution as well as to reapply stored solutions.

The plant systems form, so to speak, the supply station. A CIP plant further includes:

rotary valves flap for the energization and deenergization of plant components, lead and return pumps to construct a cleaning circuit, pipeline systems for the cleaning lead and return, spray units/spray heads, in particular permanently built in, non-rotating low pressure spray heads, measuring and regulating systems to ensure reproducible cleaning sequences depending upon the degree of automation, e.g. flow meters for regulating the quantity of fresh water, thermometers, pressure measuring devices, etc., and an electrical control/regulating system, in particular in the form of stored-programme-controllable, service-friendly control systems, possibly in conjunction with process data acquisition for the documentation of the cleaning sequences.

With respect to the "filler external cleaning" and "hot water flooding" parts of the plant, there are further added the necessary plant components.

According to the prior art, all cleaning plants for a filling plant are equipped in each instance with their own supply stations and different application-engineering components, as well as with separate control systems. Accordingly, in the known case the expenditure on equipment for cleaning a complete filling plant is relatively great. In addition, with regard to application engineering the design of plants is relatively costly and complex because it has to be aimed at the respective filling plant.

Furthermore, with regard to process engineering the control of the sequences is complex by reason of the necessary coupling of the cleaning systems. Since each partial plant has microbiological effectiveness only for itself, there is no closed microbiological coverage of the entire region. The object of the invention is to refine the initially designated plant for cleaning a filling plant in such a way that the expenditure on equipment can be kept small and, in terms of process engineering, the plants can be operated in a better fashion, and also, in terms of microbiology, no "gaps in the cleaning" occur.

DEFINITION OF THE INVENTION

According to the invention, the object is achieved in that for all partial cleaning systems there is provided within a common central cleaning circuit a common supply station comprising the components
=fresh water container
=storage container
=a heating station
=a dosing station,
which can be selectively connected to and respectively disconnected from the cleaning circuit by means of valves and rotary valve flaps, a programme control system, which possesses programme parts both for a sequential and also for a partially parallel activation of the partial cleaning systems, and a common partial line system.

DETAILED DESCRIPTION OF THE INVENTION

Figure 1:
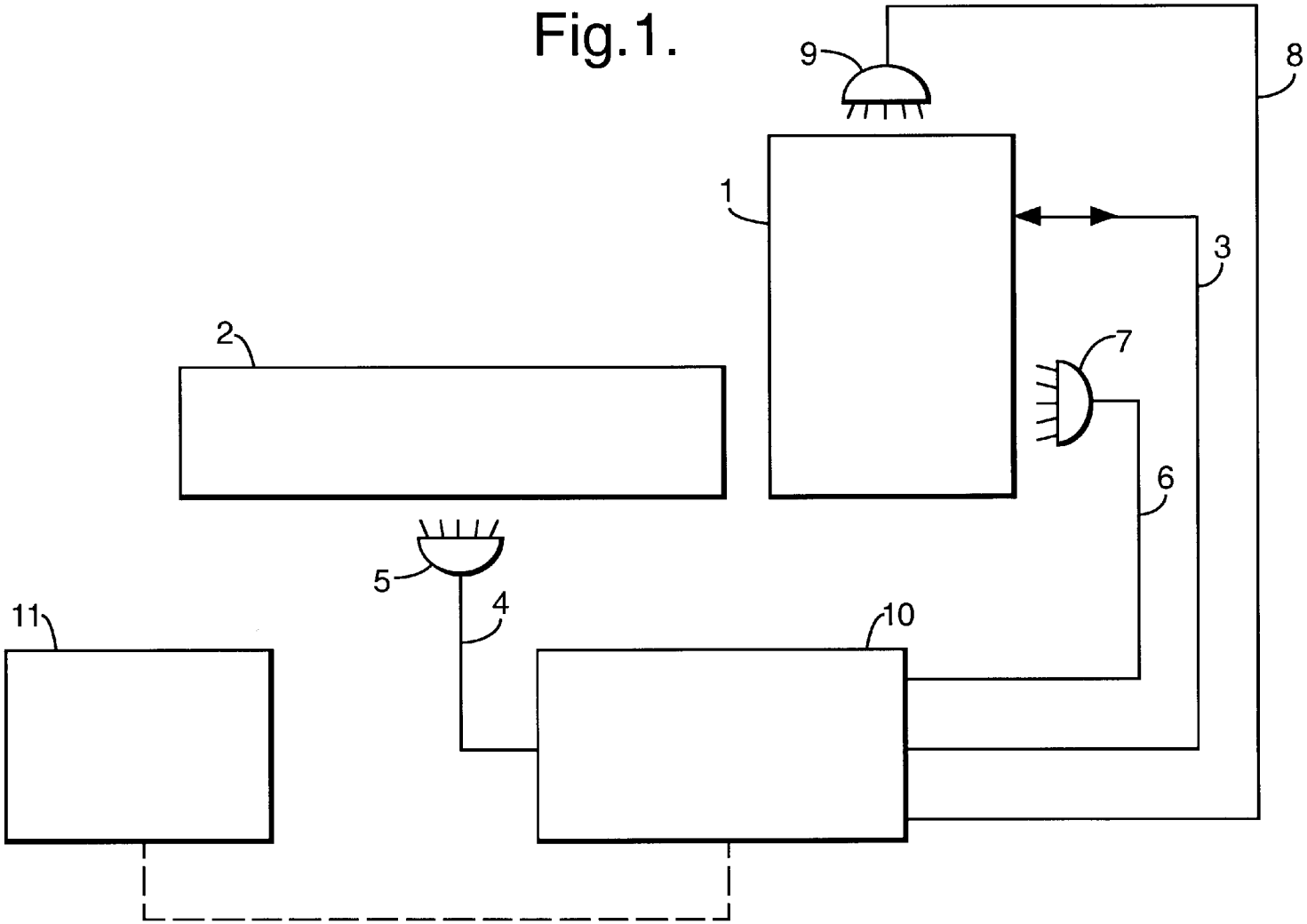

The advantages attained by the plant according to the invention are both of an application-engineering and process-engineering nature and also of a microbiological nature, associated with a considerable reduction in overheads as a consequence of the drastic reduction of the plant investment costs which are generated by the use of only one supply station (in place of four individual supply stations), a combined control system (in place of four individual control systems) and only one line system, which can be used in part for all cleaning components. The cleaning products which are used for CIP cleaning can also be used for external cleaning.

The advantages in terms of application engineering reside in that the components necessary for optimal cleaning: mechanical system, temperature, concentration, time for all four components to be cleaned can be selectively connected thereto or disconnected therefrom. For reasons of cost, the systems which are currently employed on the market are designed only for the respectively essentially required parameters. Since, by way of example, a filler CIP plant is equipped with a heat exchanger, the latter can also be used for the partial heating of the cleaning components in the conveyor CIP plant and for the filler external cleaning. There are also advantages in terms of process engineering. Since the plant according to the invention must cover a capacity range of approximately 1 $m^3$ to approximately 50 $m^3/h$ (the filler CIP requires a maximum of approximately 50 $m^3/h$, the filler external cleaning a minimum of 1 $m^3/h$), it is possible to incorporate process-engineering components for the purpose of achieving this. By way of example, it is possible to provide a circuit switching for the water in the course of the "foaming" programme step in the case of the filler external cleaning. Using this partial circuit switching, it is possible advantageously to cover both differing quantities and also pressure requirements of the individual cleaning components. The microbiological advantages reside in that, using this plant, no "gaps in the cleaning" occur any longer in the filler region which is difficult to clean in hygienic fashion, but it is possible to speak of a microbiological universality.

The initially cited DE 44 34 407 A1 has indeed already disclosed a cleaning plant for a filling plant which serves to clean the containers fed to the filler and at the same time to clean the filler itself.

However, in the known case the plant serves primarily to clean the containers and concerns secondarily the internal cleaning of the filler, while on the other hand the invention does not concern the cleaning of the containers but the cleaning of the complete filling plant with internal and external cleaning of the filler and of the conveyor, i.e. a cleaning system in the case of which entirely different boundary conditions and problems are present as compared with the known case.

According to a first further development of the invention, the common cleaning circuit has a central lead pump with a central suction line and a central cleaning lead line conducted via the heating station, there being connectable to the central suction line on the one hand the fresh water container, which can be supplied, via a valve arrangement, alternatively with cold or warm water, with its drainage via a rotary valve flap and, on the other hand, the storage containers with four stored media lye, hot water, acid and return water with their drainages in each instance via associated rotary valve flaps, a common first suction line, a further rotary valve flap and a rotary valve flap decoupling the connection of the fresh water container from that of the storage tanks, and the central cleaning lead line being connectable via a rotary valve flap to the cleaning lead of the filler CIP cleaning, via a rotary valve flap to a collecting line with downstream rotary valve flaps of the CIP cleaning system of the conveyor and via a rotary valve flap to a collecting line with downstream rotary valve flaps of the hot water flooding system.

With such a design of the plant, it becomes possible to use numerous components for the individual cleaning systems in common.

According to a further refinement of the invention, there is provided a second cleaning lead line which is connectable via a valve to the central cleaning lead line, and which is connectable via a rotary valve flap to the collecting line with downstream rotary valve flaps of the filler external cleaning system.

As a result of this, it is possible to run the cleaning system of the filler external cleaning simultaneously with the CIP cleanings of the conveyor.

According to a further refinement of the invention, the cleaning return of the filler CIP cleaning is expediently connected via a rotary valve flap to a third suction line, to which the storage inlets of the storage containers are connectable in each instance via rotary valve flaps. In this way, a simple feedback of the stored media into the storage containers using only a central lead pump is possible.

According to a further development of the invention, there is provided a central dosing station for cleaning agents and disinfecting agents, which is connectable alternatively via valves to the central suction line of the pump and, on the other hand, directly via valves to the second cleaning lead line.

In this way, different cleaning agents can be fed into the two cleaning lead lines.

According to a further refinement of the invention, there is provided a rotary valve flap switching system, via which a connection is switchable between the central cleaning lead line and the cleaning return of the filler CIP cleaning. By this means, it is possible to create a short circuit between the cleaning lead and the cleaning return, which can be utilized for the most widely varying purposes. Thus, in the hot water flooding mode of operation, for example, a circuit connection for the storage container containing the hot water can be created, so that a large quantity of hot water is available for flooding. It is also possible to activate a self-cleaning of the storage containers using the cleaning agents from the central cleaning lead line.

According to a further development of the invention, between the connection of the third suction line with the associated rotary valve flap to the cleaning return and the connection of the first suction line with the associated rotary valve flap to the central suction line of the pump there is incorporated a second suction line which forms a bypass for the return of the stored media into the storage containers. By this means, it is possible to heat not the entire contents of the respective storage container, but only the circulating stored medium; this saves time and energy costs.

In order that the stored media should not have any effect on one another, there is provided for the first suction line a leakage rotary valve flap with a downstream outlet and, in the same way, there is provided for the second and third suction lines in each instance a rotary valve flap with a downstream outlet.

Further refining features and advantages of the invention are evident with reference to the description of an illustrative embodiment shown in the drawings.

Figure 2:
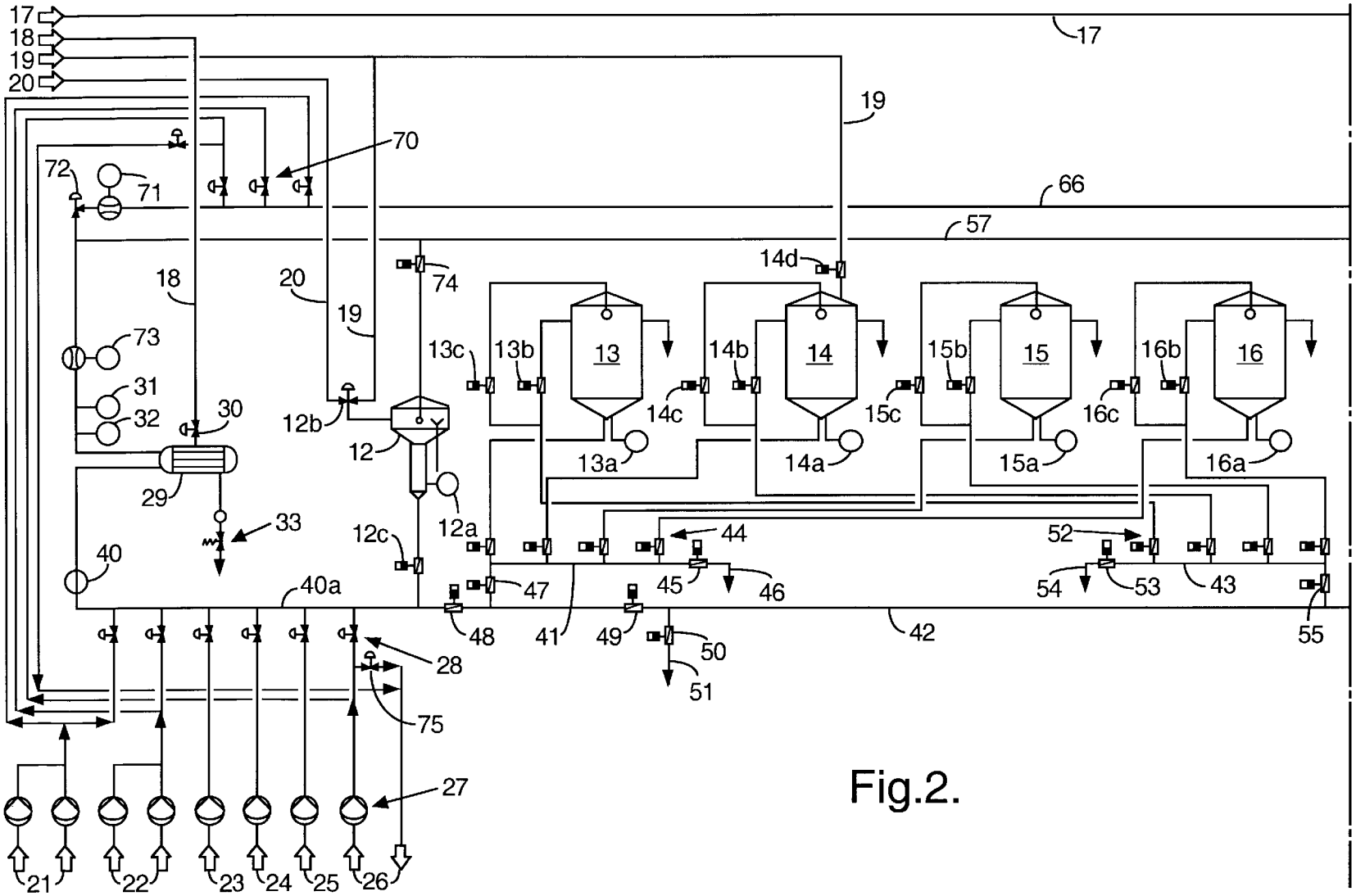
Figure 2:
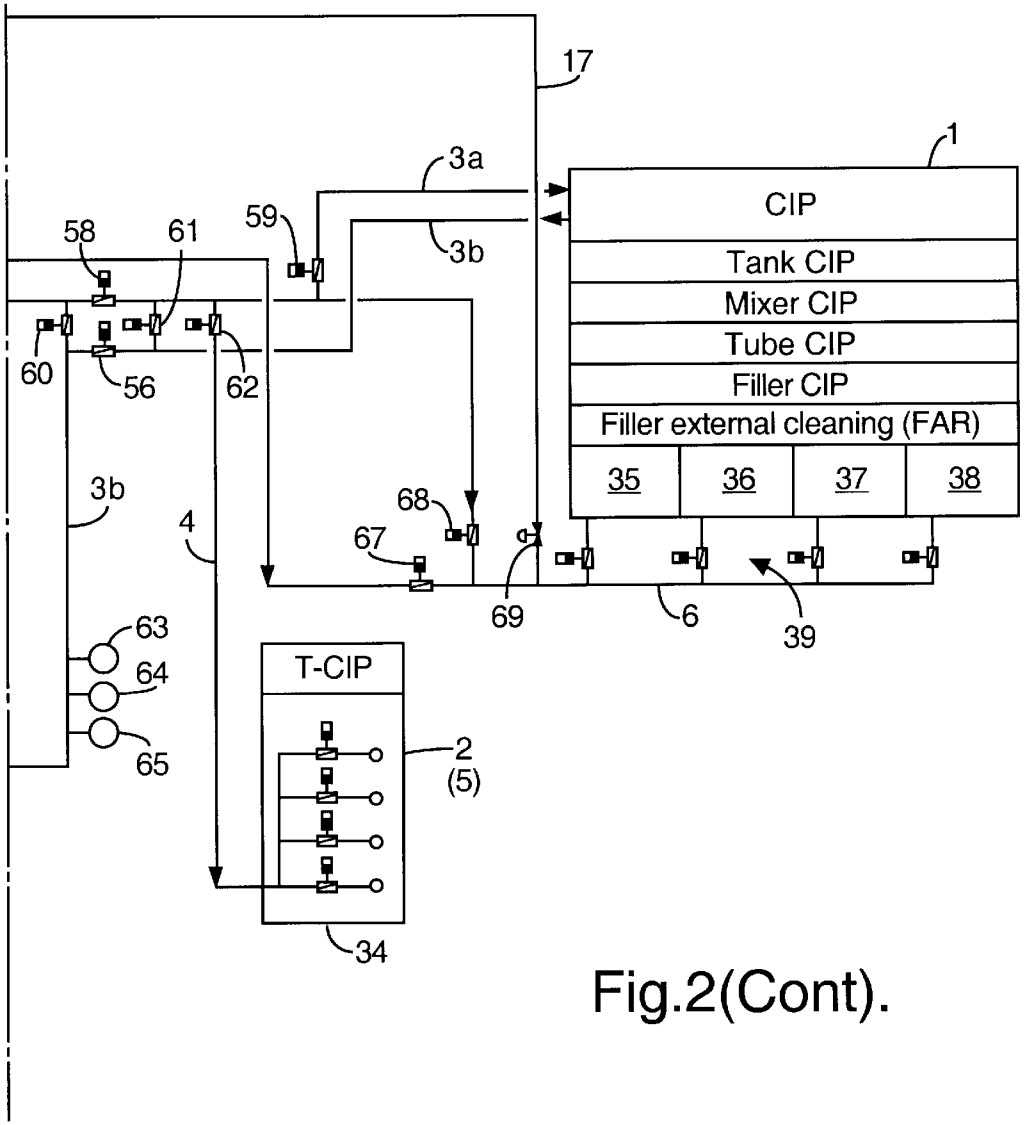
Figure 3:
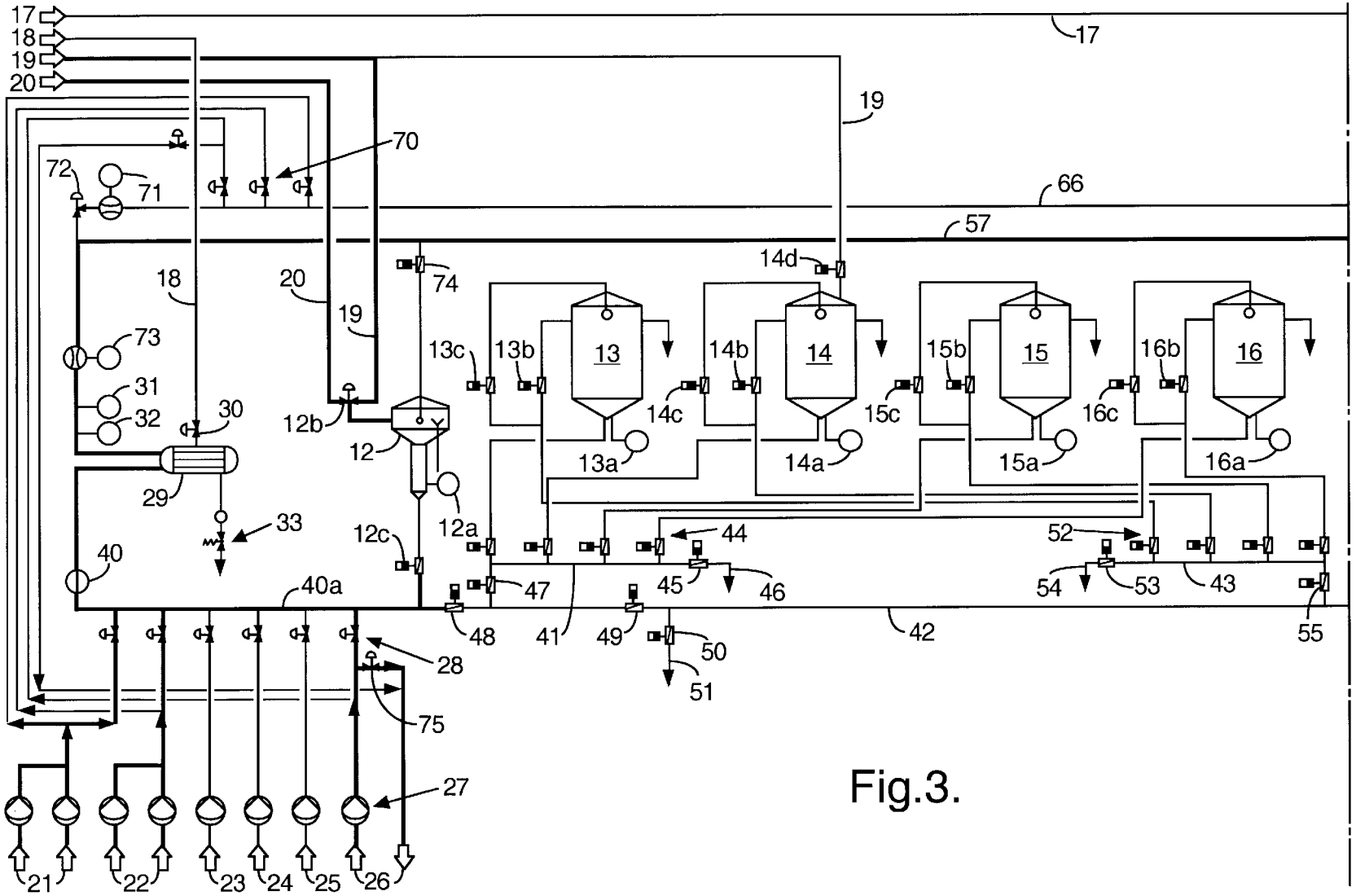
Figure 3:
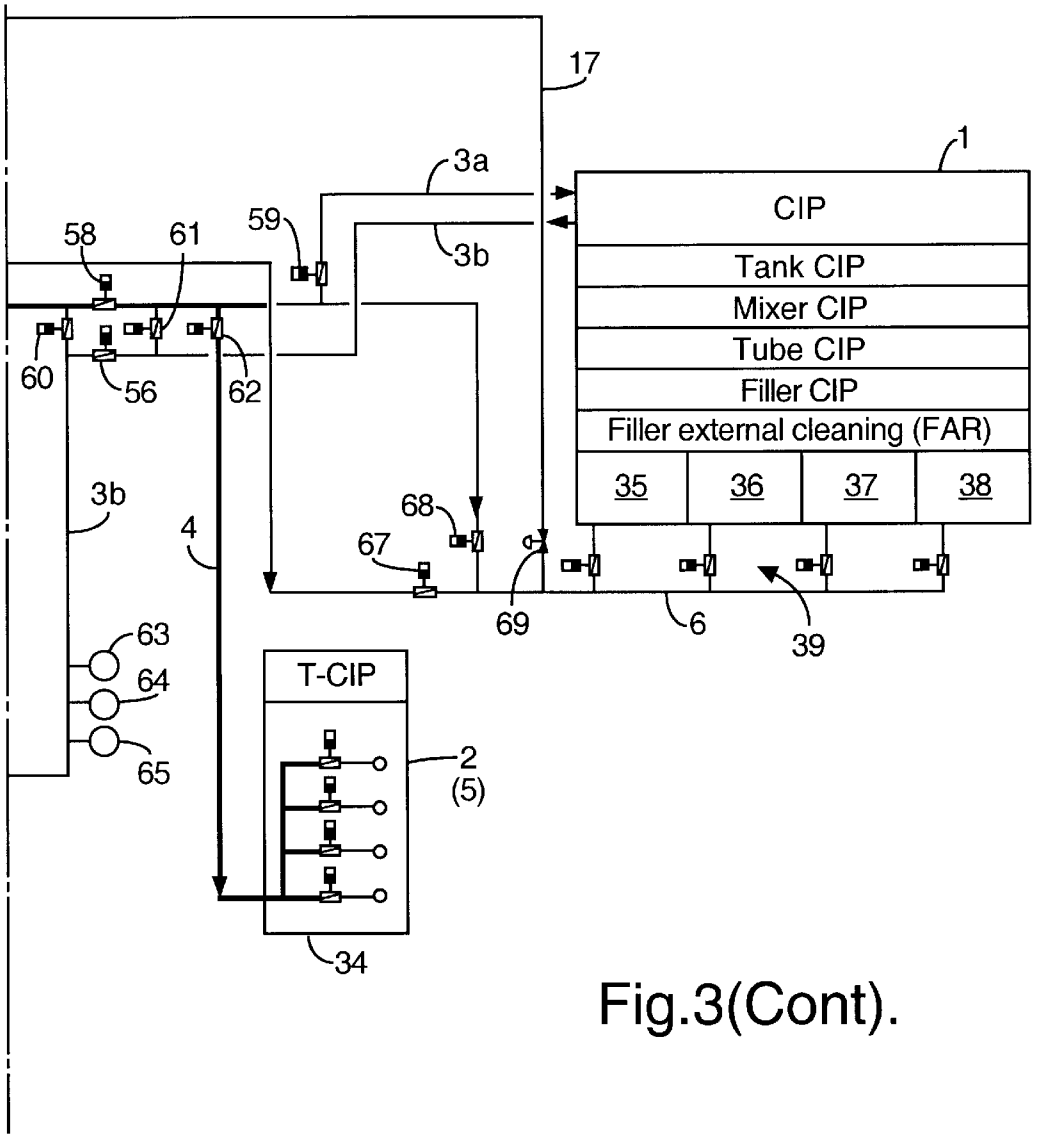
Figure 4:
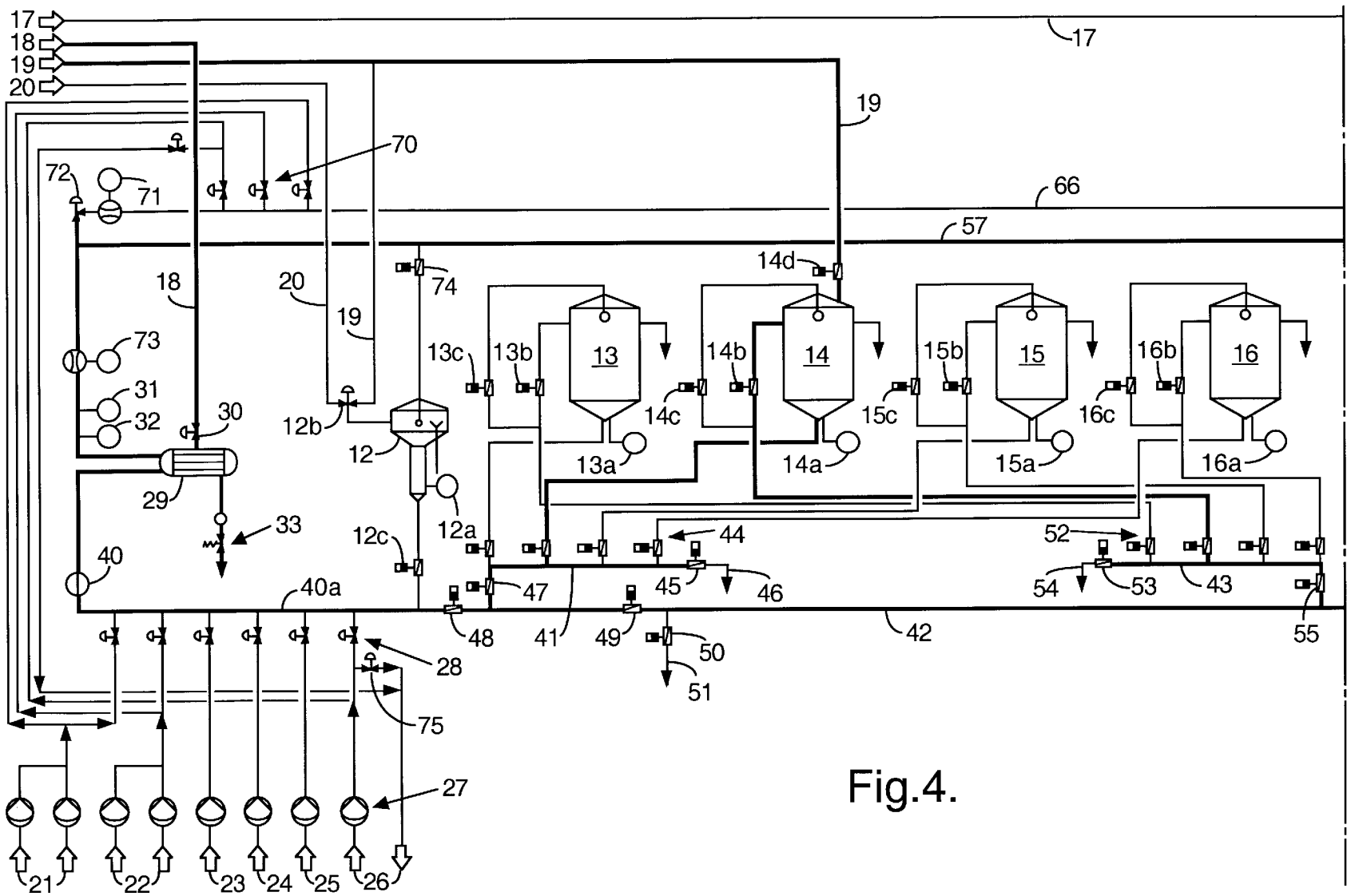
Figure 4:
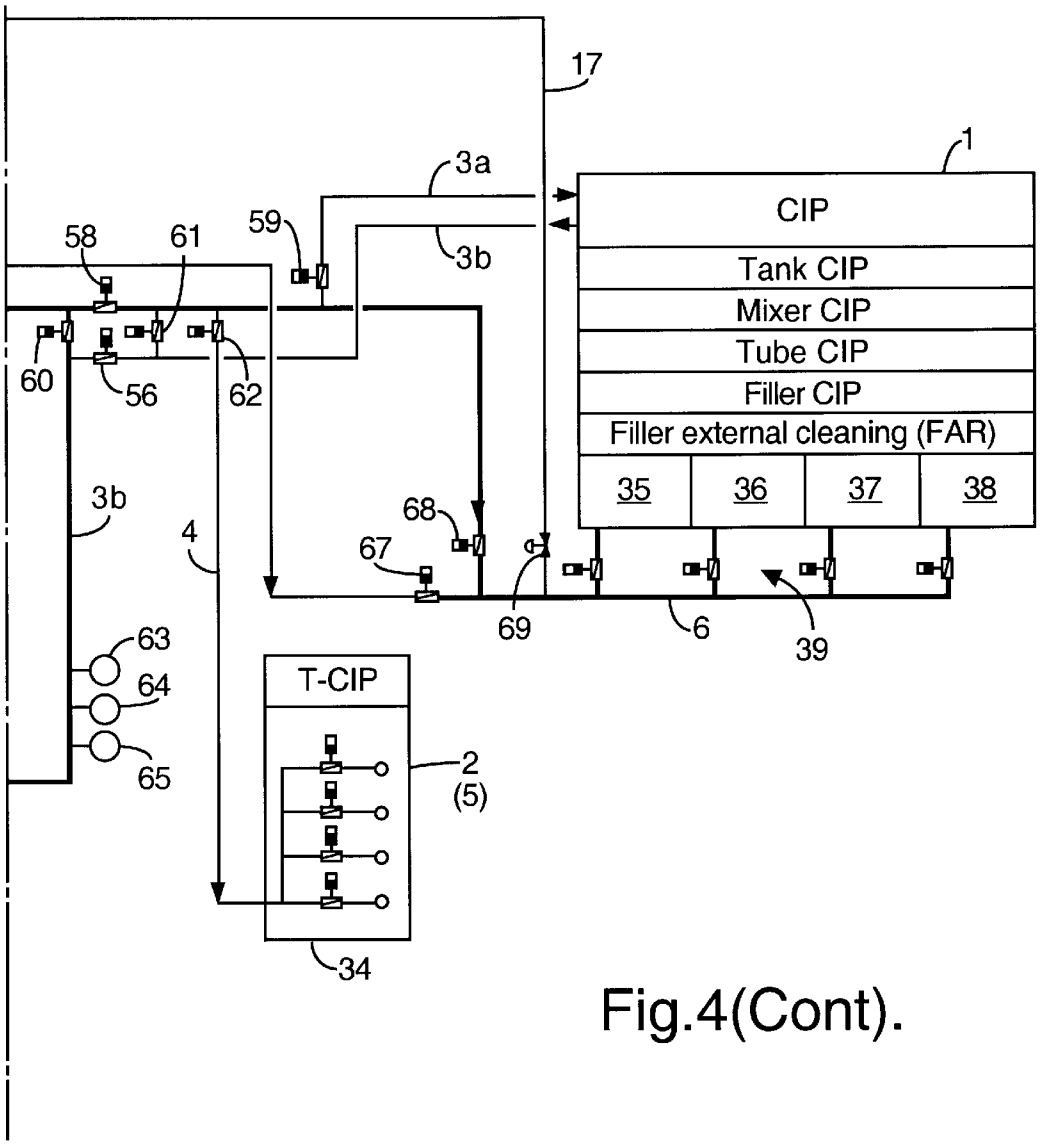
Figure 5:
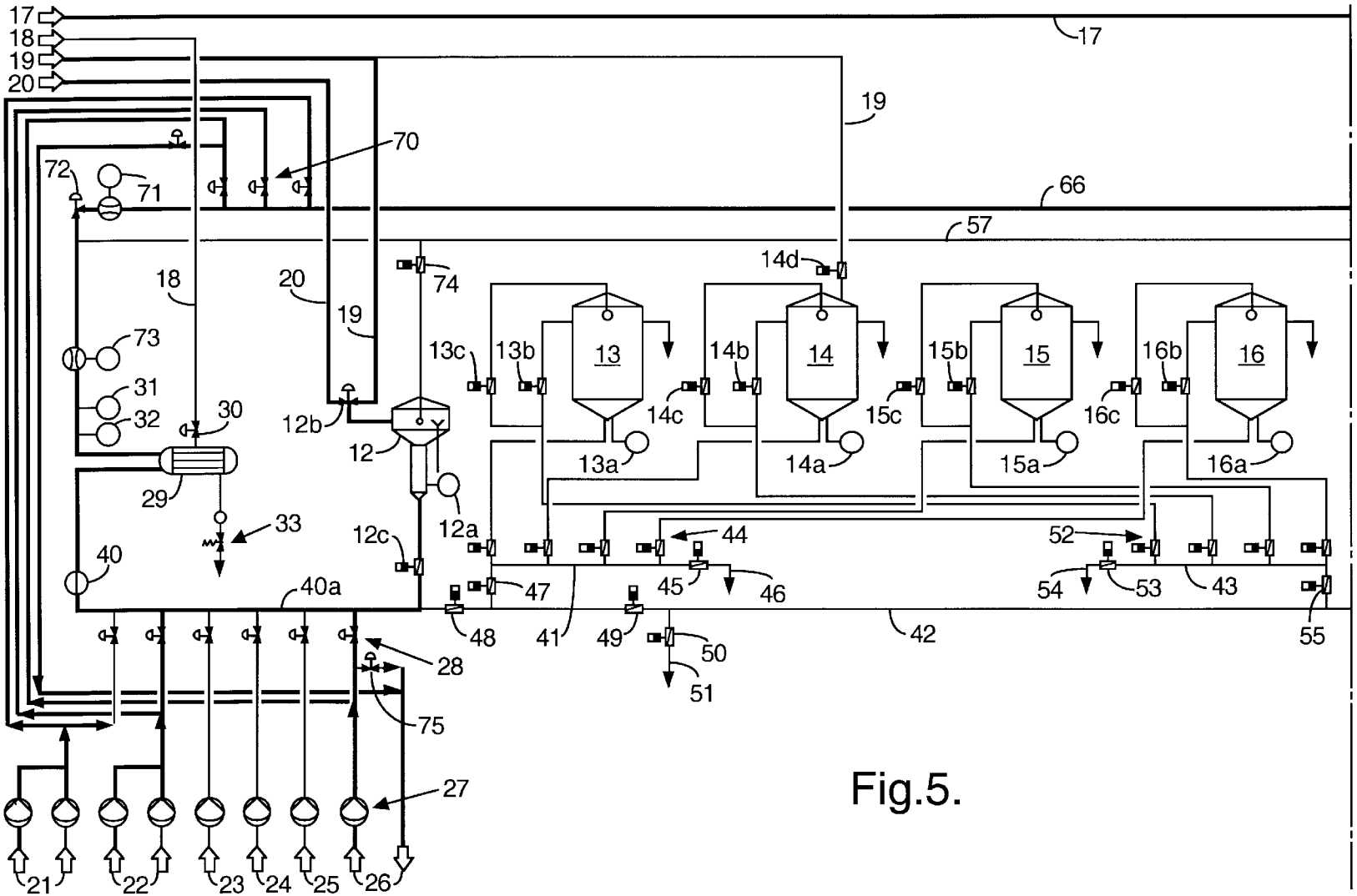
Figure 5:
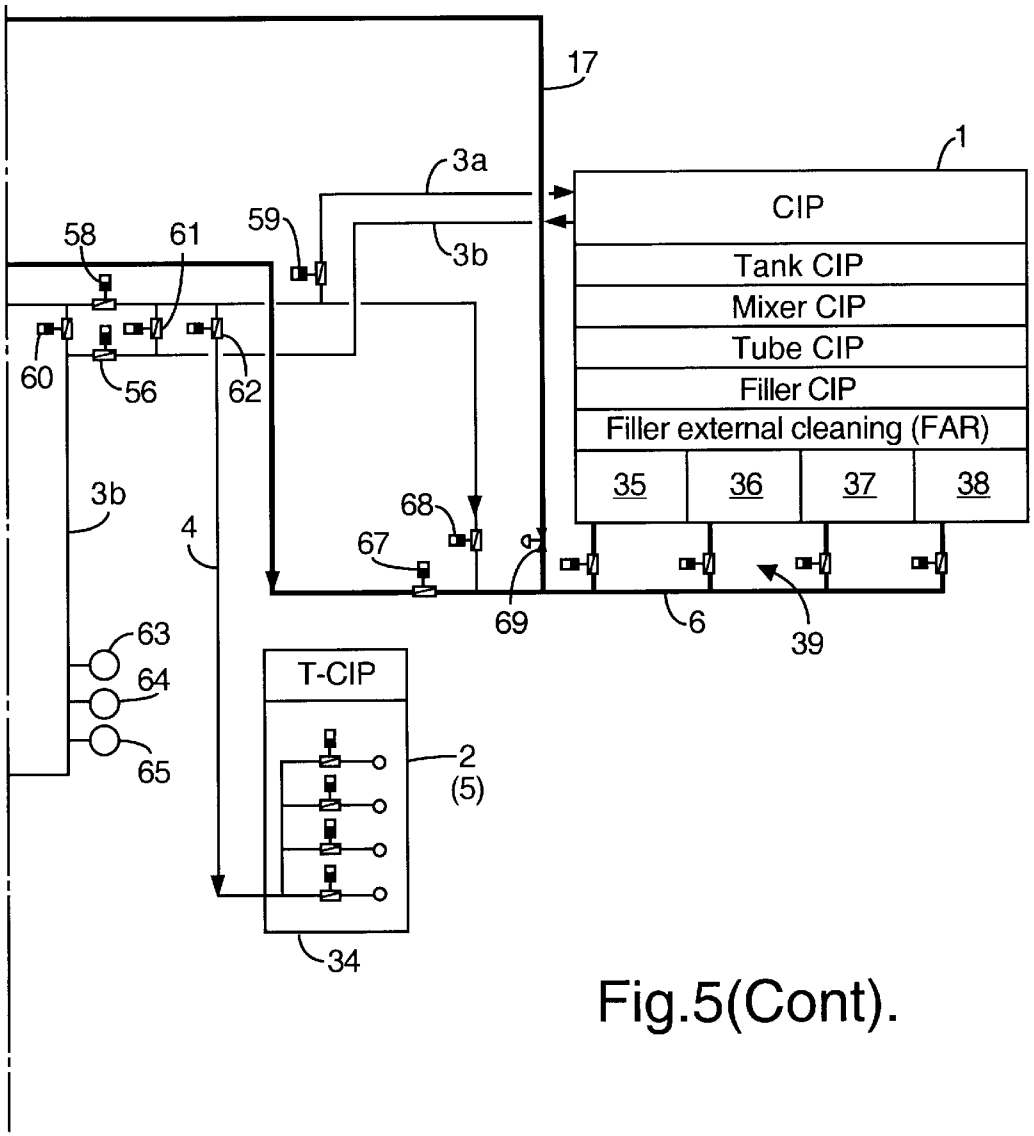
Figure 6:
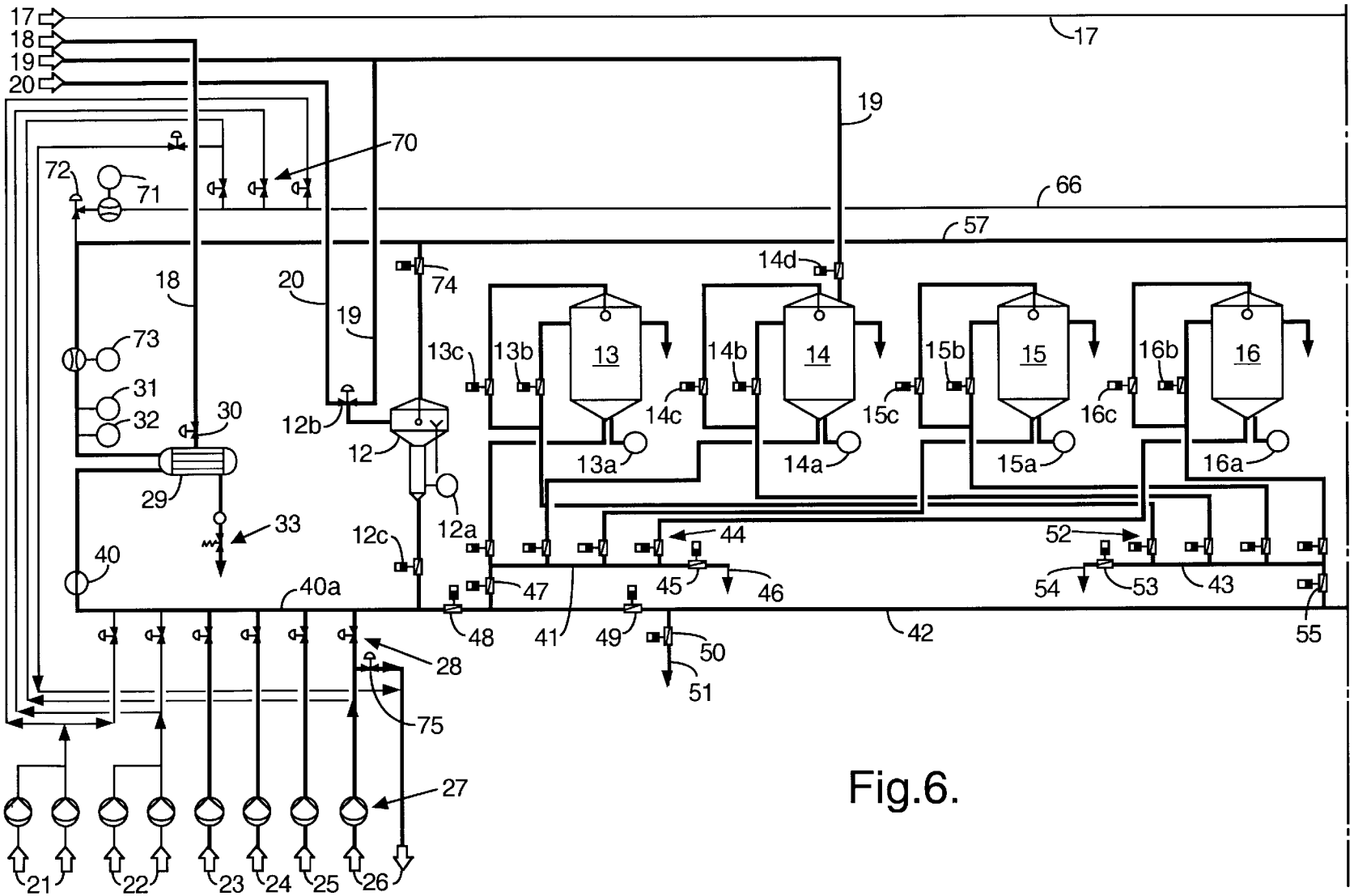
Figure 6:
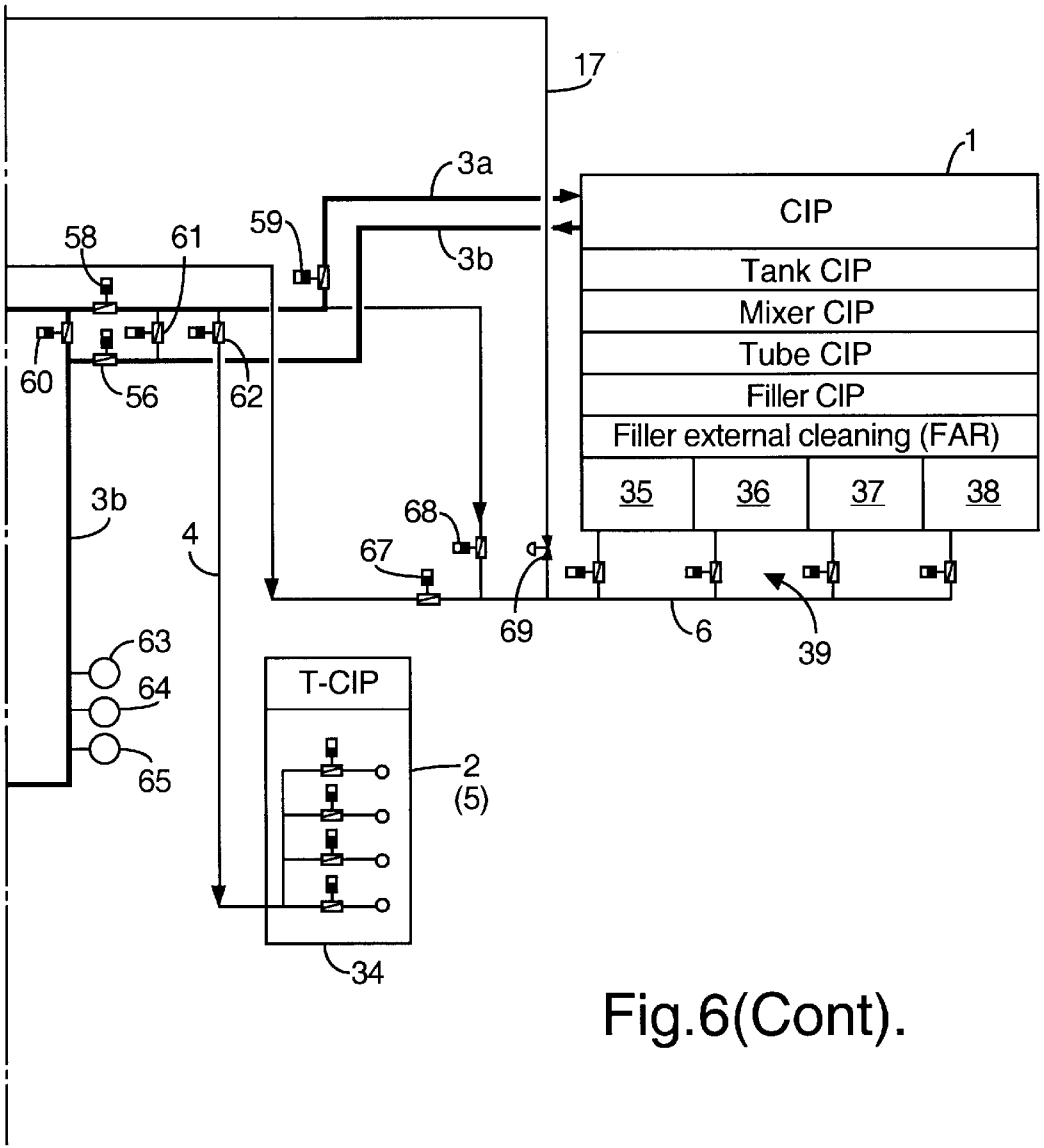

In the drawings:

FIG. 1 shows in a highly diagrammatic block diagram, the plant according to the invention for cleaning a filling plant, FIG. 2 shows in a block diagram, the construction of the common supply station of the cleaning plant according to FIG. 1, FIG. 3 shows a block diagram according to FIG. 2, with marking of the line path in the case of the CIP cleaning of the conveyor, FIG. 4 shows a block diagram according to FIG. 2, with marking of the line path in the case of hot water flooding, FIG. 5 shows a block diagram according to FIG. 2, with marking of the line path in the case of the filler external cleaning, and FIG. 6 shows a block diagram according to FIG. 2, with marking of the line path in the case of the CIP cleaning of the filling station.

FIG. 1 shows, in a highly diagrammatic block diagram, the plant according to the invention for cleaning a filling plant, which consists of a filler 1 and a conveyor 2, which, in a known manner, conveys the containers to be filled to the filler 1 and hereafter away from it.

A cleaning plant for such a filling plant typically consists of four cleaning systems, namely a CIP cleaning system for the filler 1, which system serves for the internal cleaning of the filler and, in FIG. 1, is symbolically represented by the line 3, as well as a CIP cleaning system for the conveyor 2, which system is symbolically represented by the line 4 with the spray head 5. By way of example, the CIP cleaning system for the conveyor 2 may advantageously be formed by the cleaning device according to the initially cited DE 19 508 357 A1, to the disclosure content of which reference is hereby made. A CIP cleaning system for the filler has been disclosed, for example, by the initially cited DE 44 34 407 A1.

In addition to these CIP cleaning systems, the plant for cleaning the filling plant has a filler external cleaning system, symbolically represented by the line 6 with the spray head 7, and a hot water flooding system, symbolically represented by the line 8 and the spray head 9. As will be stated in greater detail with reference to FIG. 2, a common line can be provided for both systems. The spray head 9 for the hot water has a greater throughput than the spray head 7. Accordingly, the nozzles are different.

For all partial cleaning systems there is provided a common supply station 10, which typically consists of a fresh water lead container and storage container, a heating station and a dosing station, as will be stated in detail with reference to FIG. 2, which shows the construction of the supply station 10. The individual components of the supply station 10 can in this case selectively be switched into and out of the cleaning circuit via valves or rotary valve flaps, referred to in the text which follows for the sake of simplicity as flaps.

For a sequentially correct actuation of the components of the supply station for the partial cleaning systems there is provided a programme control system 11, which possesses programme parts both for a sequential and also for a partially parallel activation of the described partial cleaning system. Expediently, this control system is constructed in modular fashion. It may be a central control system, but it can also be associated, in a design which is the same in terms of hardware, on a decentralized basis with partial cleaning systems. By reason of the local arrangements, an example would be one for the filler external cleaning and the CIP conveyor on the filler and one on the CIP cleaning for the filler. As a result of the modular construction—only the programmes are different—they are exchangeable in the event of a breakdown—if the pertinent programme is loaded. Furthermore, it is evident from the representation according to FIG. 1 that a common partial line system is provided for the entire plant for cleaning the filling plant.

The cleaning system 8, 9 of the hot water flooding is in principle likewise a system for the external cleaning of the filler 1. It represents a supplement to the filler external cleaning system 3 for parts of the filler which are to come into contact alternately with foaming agents. In the text which follows, the construction of the common supply station 10 is described with reference to FIG. 2. FIG. 2 shows the supply station of the cleaning plant according to the invention for a filling plant with filler and conveyor with four different cleaning systems, which are formed by selective connection and disconnection of the individual components via valves or flaps to or from the respective cleaning circuit on the basis of control signals of the central programme control unit 11, in part operating in parallel.

The cleaning plant has as central component a fresh water container 12, designed as a static foot, as well as storage containers 13, 14, 15, 16, with the storage container 13 for caustic soda (NaOH), the storage container 14 for hot water, the storage container 15 for acid and the storage container 16 for return water.

The advantages of the static foot are:

minimization of the mixed phases the supply pressure on the lead pump is more constant the expulsion of existing gas bubbles, since only thereafter is CIP cleaning possible.

In all containers 12–16, the level measurement takes place via an associated continuous filling level measurement 12*a*–16*a* which is symbolically indicated in FIG. 2. In the usual manner, the containers 12–14 have filling connections, return connections and lead connections to draw off the liquids situated in the containers.

At the upper left margin of FIG. 2 are the inlets for process media, and specifically the line 17 for air the line 18 for hot water/steam the line 19 for warm water and the line 20 for cold water (mains water).

The line 19 for warm water and the line 20 for cold water are connectable, via a three-way valve 12*b*, alternatively to the fresh water container 12.

The line 19 is, in this case, connectable via a flap 14d, also to the container 14 for hot water.

At the lower left margin of FIG. 2 there are provided the inlets for cleaning agents, and specifically the lines 21 for alkaline foam cleaner lines 22 for acidic foam cleaner line 23 for lye line 24 for additives line 25 for acid and the line 26 for disinfecting agents.

Furthermore, the plant has a dosing station for these cleaning agents in the form of dosing pumps which are generally designated by 27 and which are associated in each instance with an inlet 21–26 and which are connectable, via regulating valves 28, in a manner which will be explained later, selectively into the cleaning circuit.

The cleaning plant according to FIG. 2 further has a heating unit with the following assemblies:

a heat exchanger 29, preferably operated in counter current, with a steam/hot water regulating valve 30 in the hot water/steam conducting line 18, an excess temperature safety device 31, a temperature regulator 32, and a condensate separator 33.

The heating unit is a unit closed in itself and can, depending upon the requirements, be switched into the individual process steps in the differing cleaning systems. The heating of the media takes place in the circuit or on a once and for all basis in the course of passage with the predetermination of theoretical temperature via the temperature regulator 32. The steam/hot water valve 30 opens and closes while being regulated via the stipulation of the temperature regulator 32. The condensate separator 33 is effective in the case of steam heating.

The regulation of the temperature in the cleaning circuit will be described later.

The parts of the filling plant which are to be cleaned are shown diagrammatically in block form in the right-hand part of FIG. 2. The block T-CIP symbolizes the conveyor 2 (FIG. 1) to be cleaned, with, by way of example, four lines which can be connected and disconnected in each instance via a flap 34 and which lead to the spray heads 5 (FIG. 1) and which are fed from the cleaning lead which still remains to be described.

The block CIP with the partial blocks tank-CIP, mixer-CIP, tube-CIP and filler-CIP symbolize the filling station 1 according to FIG. 1, to which a cleaning lead 3*a* and a cleaning return 3*b* are connected.

The block filler external cleaning (FAR) symbolizes by way of example four external regions of the filler which are to be cleaned, namely within the subblock 35 the region "sealer; discharge star sealer", within the subblock 36 the region "inlet/discharge star filler", within the subblock 37 the region "filler silhouette" and within the block 38 the region "rotaflow". All regions 35–38 together with their associated spray heads 7 are selectively connectable and disconnectable via separate lines with flaps 39, which are fed from the collecting line 6 according to FIG. 1.

For the cleaning step "hot water flooding", in contrast to what is shown in FIG. 1, in the case of the embodiment according to FIG. 2 no special line system is provided, but this cleaning step takes place via the line system for the filler external cleaning, i.e., in the case of the plant according to FIG. 2 the lines 6 and 8 as well as in part the spray heads 7 and 9 of the plant according to FIG. 1, so to speak, quasi-coincide; in this case, additional spray heads with correspondingly large nozzles for the high hot water throughput are provided.

To achieve a cleaning circuit, a pump 40 is provided, with which there are associated a suction line 41, a second suction line 42 and a third suction line 43. The first suction line 41 is connected, via separately activatable flaps 44, in each instance to the lower lead connections of the containers 13–16 and is connected via a flap 45 to a drainage outlet 46 and via a flap 47 to the second suction line 42.

Two flaps 48, 49 for the mutual decoupling of the first and second suction lines are connected into the second suction line 42.

To the second suction line 42 there is further connectable a drainage outlet 51 via a flap 50, as well as the fresh water container 12 via a flap 12*c*.

The third suction line 43 is connected via separately activatable flaps 52 and alternatively actuated flaps 13*b*, *c*–16*b*,*c* to upper connections of the containers 13–14, the function of which will be further explained later. A drainage outlet 54 is further connectable to the third suction line via a flap 53. The third suction line is connectable to the second suction line via a flap 55. The second suction line is directly connected to the cleaning return 3*b*, which can be interrupted by means of the flap 56. The pump circuit is closed by means of a cleaning lead line 57, which opens into the cleaning lead 3*a* via flaps 58 and 59, i.e. can be disconnected from the direct cleaning lead 3*a*. The connecting line to the cleaning return 3*b* is provided upstream of the flap 58 via a flap 60. Likewise, a connecting line to the cleaning return 3*b* is provided downstream of the flap 58 via a flap 61; in this case, a further flap 56 is connected between the openings of the connecting lines into the cleaning return. With the aid of these flaps, it is possible inter alia to create a short circuit between the cleaning lead 3*a* or the cleaning lead line 57 and the cleaning return 3*b*, as will further be explained later.

Furthermore, the collecting line 4 of the CIP cleaning system for the conveyor 2 (block 34) is connected to the cleaning lead line 57 via a flap 62.

Furthermore, into the cleaning return line 3*b* there are inserted three measurement points, namely a flow monitor 63 to monitor the rate of flow in the cleaning return, a temperature-compensated conductivity measurement probe 64 for monitoring the concentration in the cleaning return within the context of the monitoring of the cleaning circuit, and a temperature measuring system 65, which is coupled to the already described heating unit.

In the case of the plant according to the invention, the recording of the temperature does indeed take place in the cleaning lead and in the cleaning return. As already described, the temperature measurement point 31 is provided in the lead to monitor an occurring excess temperature, whilst the regulation of the temperature for reasons based on application engineering takes place via the temperature measuring system 65 installed in the cleaning return.

The supply station according to FIG. 2 also has a second cleaning lead line 66, which is connectable via a flap 67 to the collecting line 6 for the filler external cleaning or the hot water flooding. This collecting line 6 is also connected via a flap 68 to the cleaning lead line 57 and via a flap 69 to the compressed-air-carrying line 17. The second lead line 66 is connectable upstream via regulating valves 70 to the dosing station 37 and is also connected, via a throughflow meter 71 and a valve 72, to the cleaning lead line 57, into which a throughflow meter 73 is also inserted. The throughflow quantity meters 71 and 73 serve to monitor the throughflow in the cleaning lead and are preferably designed as magnetically inductive systems. The cleaning connection of the fresh water container 12 is further connectable via a flap 74 to the cleaning lead line 57; in this case, the small circle symbolizes a spray head, just as in the case of the containers 13–16.

With the supply station according to FIG. 2, the four initially described cleaning systems can be realized by the common programme control system 11 (FIG. 1); in the text which follows, this is to be described in greater detail with reference to FIG. 2.

In the first instance, the CIP cleaning for the conveyor 2 is described with reference to FIG. 3.

Depending upon the requirement, cold or warm water passes via the valve 12b from the lines 20 or 19 via the fresh water container 12 and the open flap 12*c*, when the flap 48 is closed, to the pump 40. In this cleaning mode, the pump is preferably frequency-regulated, and conveys as a function of the throughflow quantity predetermined at the throughflow meter 73. The valve 72 is closed, so that the cleaning lead line 57 is switched into the circuit. The flaps 56, 59, 60 and 61 are closed, whilst the flaps 58 and 62 are open, so that the cleaning lead line 57 is connected to the collecting line 4 leading to the conveyor. The flaps 34 in the spray arrangement of the conveyor open one after the other.

In the case of this CIP cleaning of the conveyor, cleaning agents are added by direct injection into the suction line of the pump 40 via the valves 28, and specifically alkaline foam cleansers are added via the inlets 21, acidic foam cleansers via the inlets 22 and disinfecting agents via the inlet 26. The dosing of the cleaning agents takes place via the respectively associated dosing pumps 27. The respective conveying media of the pump can be heated in the heating unit 29, 30.

The programme control system 11 (FIG. 1) provides for the following process steps for the cleaning sequence of the CIP cleaning of the conveyor:

| Process step No.: | Designation |
|---|---|
| Step No. 1: | Pre-rinsing with water |
| Step No. 2: | Apply foam product |
| Step No. 3: | Time for action |
| Step No. 4: | Rinsing away with water |
| Step No. 5: | Apply disinfecting agents |
| Step No. 6: | Time for action |
| Step No. 7: | Rinsing away with water |
| Step No. 8: | Apply belt lubricants |

In order to avoid the loss of unnecessary quantities, before commencement of the step these cleaning agents are conducted as precisely as possible, using the scraper principle ahead of the flaps 34, i.e. by way of example, the foam product is already being conveyed in the pipeline, but the current applicant is still in the step "Pre-rinsing with water".

Both dosing pumps 27, which are situated in each instance both in the alkaline and in the acidic foam cleaning track, are preferably driven; in this connection, one of the pumps is run in each instance at a constant value and the other pump is run in frequency-regulated fashion. Via the stipulation of a theoretical concentration and conversion of the total mixing quantity at the throughflow quantity meter 73, the foam product can be precisely dosed into the water stream by switching in the valve 28. The associated valve 70 is closed, so that no liquid passes into the second cleaning lead line 66.

In corresponding fashion, the disinfecting agent is dosed in via the inlet and the associated pump 27 and by switching in the associated valve 28, into the water stream in the central suction line 40*a*.

In the event that degassing disinfecting agents are used, the complete disinfecting agent line is vented via the valve 70 prior to a dosing.

A sufficient intermixing of the substances is accomplished on the one hand by the turbulence in the impeller of the pump 40 and through the stream which is maintained in a turbulent condition in the cleaning lead line 57.

A further cleaning system is the mentioned "hot water flooding" for the external cleaning of the regions 35–38 of the filler via the collecting line 6 and the flaps 39. The pertinent line path is marked in FIG. 4.

A hot water flooding is advisable only in circumstances in which a sufficiently large quantity of hot water which is applied in flooding fashion is conducted to the filler within a short period of time. In use, temperatures of ≧90° C. must be run, in order to achieve a germ-destroying effect.

When the cleaning procedure "hot water flooding" is started, hot water stored in the container 14 runs via the associated open flap 44 and the flaps 47, 48 to the pump 40; subsequently, the hot water is additionally heated in the heat exchanger 29 of the heater station, which heat exchanger is heated with hot water/steam via the valve 30 and the line 18. After this, a circuit arrangement is created by the control system 11. To this end, the flap 60 is opened and the flaps 56 and 58 are closed, in order in this way to create a short circuit between the cleaning lead and the cleaning return. The hot water—in the circuit—passes via the open flap 55, the third suction 15 line 43 and the associated open flap 52 as well as the open flap 14*b* at the hot water container 14, back into the container 14. In this way, the complete hot water container 14 is kept to temperature.

When a requirement for hot water arises at the filler, by 20 cancelling the short circuit arrangement and opening the flap 68, the filler external cleaning nozzle system 7 or 9 (FIG. 1) the hot water is utilized in the regions 35–38 at the filler via the collecting line 6 and the opened flaps 39.

A third cleaning system is the filler external cleaning in the regions 35–38 via the collecting line 6 and the flaps 39. Those elements of FIG. 2 which serve for the supply for this cleaning are described in the text which follows as marked in FIG. 5.

Depending upon the requirement, cold/warm water passes via the valve 12*b* from the lines 20 or 19 via the fresh water container 12 and the open flap 12*c*, when the flap 48 is closed, to the central suction line 40*a* of the pump 40. The pump 40 is set to a fixed value and the open regulating valve 72 regulates the throughput as a function of the throughflow quantity which is fixedly predetermined at the throughflow measuring system 71. To establish the regulating circuit for the cleaning lead, the flap 58 is closed, so that the cleaning lead is implemented only via the lead line 66 and not via the lead line 57. Likewise, the flaps 56, 60, 61, 62 are closed in the short circuit arrangement. In contrast, the flap 67 is open, so that the cleaning lead line 66 is connected to the collecting line 6 of the filler external cleaning. Via this collecting line, the respective media are successively utilized at the application regions 35–38 via the flaps 39. In specified process steps, air from the supply line 17 is admitted via the valve 69.

In the case of the filler external cleaning, cleaning agents are likewise added, but by direct injection into the cleaning lead line 66 via the valves 70, and specifically alkaline foam is added via the inlet lines 21, acidic foam via the inlet lines 22 and disinfecting agents via the inlet 26.

The dosing of the cleaning agents takes place in each instance via the associated dosing pump 27.

The respective media being conveyed can be heated in the heating station.

The programme control system 11 (FIG. 1) provides for the following steps for the cleaning sequence in the case of the "hot water flooding":

| Process step No.: | Designation |
|---|---|
| Step No. 1: | Pre-rinsing with water |
| Step No. 2: | Apply foam product + air |
| Step No. 3: | Time for action |
| Step No. 4: | Rinsing away with water |
| Step No. 5: | Apply disinfecting agent |
| Step No. 6: | Time for action |
| Step No. 7: | Rinsing away with water |

In order to avoid the loss of unnecessary quantities, these media are conducted as precisely as possible using the scraper principle ahead of the flaps 39 prior to commencement of the step, i.e., by way of example, the foam product is already being conveyed in the pipeline, but the current application is still in the step "Pre-rinsing with water".

The two pumps 27 associated with the foam cleaning tracks 21 and 22 are regulated in their conveying capacity. Via the stipulation of a theoretical concentration and conversion of the total mixing quantity at the throughflow quantity meter 71, the foam product can be dosed precisely into the water stream by switching in the valves 70 associated with the alkaline foam cleanser and the acidic foam cleanser.

The disinfecting solution is dosed in directly into the water stream flowing to the pump 40 in the central aspiration tube 40*a*, via the associated pump 27 and through switching in the associated valve 28.

In the event that degassing disinfecting agents are used, the complete disinfecting agent line is vented via the valve 75 prior to a dosing.

A sufficient mixing of the substances is accomplished on the one hand by the turbulence in the impeller of the pump and through the stream which is maintained in a turbulent condition in the cleaning lead tube 66.

For the step No. 2 "Apply foam product", a quantity of air which is freely adjustable for each area of application is added via the same regulable valve 69 to the foam product premixed in water. By this means, a variation in the foam consistency is possible.

Finally, the fourth cleaning system is the CIP cleaning—marked in FIG. 6—of the filling station, which can be used for the filler CIP mixer CIP tube CIP tank CIP and in combination of the first mentioned.

This CIP cleaning has the following process steps:

| Process step No.: | Designation |
|---|---|
| Step No. 1: | Pre-rinsing with return water from the storage tank |
| Step No. 2: | Cleaning under alkaline conditions in the circuit |
| Step No. 3: | Intermediate rinsing with fresh water |
| Step No. 4: | Return storage in the lye |
| Step No. 5: | Cleaning under acidic conditions in the circuit |
| Step No. 6: | Return storage of the acid |
| Step No. 7: | Intermediate rinsing with fresh water |
| Step No. 8: | Cleaning, disinfecting in the circuit |
| Step No. 9: | Cleaning, disinfecting with hot water |

Depending upon the requirements, cold or warm water passes via the valve 12*b* from the lines 20 or 19 via the fresh water container 12 and the open flap 12*c*, when the flap 48 is closed, to the central suction line 40*a* of the pump 40. The stored media lye (in the container 13), acid (in the container 14), hot water (in the container 15) and return water (in the container 16) pass via the flap 44 which is in each case open in the first suction line 41 and via the flaps 47 and 48 to the central suction line 40a of the pump 40. Via the leakage flap 45, the residual quantity of product is discharged into the drainage outlet 46 between the individual steps, in order to prevent mixing and reaction between the different stored media.

The neutral position of the flaps 58 and 60 sets the path via the open flap 49 for the CIP cleaning. The path settings within the applications are carried out by the respective external control and are transmitted by means of a clearance signal to the central unit.

The pump 40 is frequency-regulated and conveys as a function of the throughflow quantity predetermined at the throughflow measuring system 73. The respective media being conveyed can be heated via the heating unit. The valve 72 is closed.

The cleaning return can be switched via the flaps

45: returned to store (3rd suction line 43)

50: into the drainage outlet 51

49: into a circuit (2nd suction line 42).

The supply station is equipped with the second suction line 42 for the reason that on this basis it is possible to circumvent the storage tank in the course of cleaning. This means that the cleaning volume necessary for a circuit is withdrawn from a storage tank and also that only this volume needs to be heated, which gives rise to a saving of heat energy and time as compared with a cleaning through the storage tank, since otherwise, in the case of cleaning through the storage tank, the entire volume of the tank would have to be heated. This volume may be many times the required circuit volume. For tube cleanings, the third suction line 43 is installed; this makes it possible, when a fresh water buffer is produced and with acid from the storage tank 15, to return the lye of the lye circuit to storage in the storage tank 13 for lye via the associated (left-hand) flap 52.

The stored media lye, acid, return water and hot water can be conducted into the corresponding storage tank 13–16 via the flap 52 which is in each instance open in the third suction line 43 together with the associated flaps 13*b*, 14*b*, 15*b* and 16*b* in the tank infeed. Via the leakage flap 53, the residual quantity of product of the respective stored medium is drained off into the drainage outlet 54 between the individual steps, in order to prevent mixing and reaction between the different stored media.

The third suction line 43 additionally makes it possible to prime the quantity contained in a lye or acid storage tank 13 or 15, independently of cleaning. To this end, the flap 60 is opened and the flaps 58 and 56 are closed, in order to create a short circuit between cleaning lead and cleaning return. In this connection, the quantity in the respective storage tank is irrelevant, since via a continuous filling level measurement the precise quantity is known to the programme control system 11 (FIG. 1), which then computes the corresponding quantity of the respective storage medium, which is required for priming to a concentration X. The conductivity of the medium, which conductivity is required for this purpose, is determined via the temperature compensated conductivity probe 63 in the cleaning return 3*b*.

Via this connection between cleaning lead and cleaning return, it is likewise possible without any problem, using the third suction line 43, to run a self-cleaning via spray heads which are installed in the storage tanks 13–16 and which are symbolically represented by a small circle at their tip.

To this end, the flaps 13*c*, 14*c*, 15*c* and 16*c* are to be opened in each instance. The cleaning of the fresh water container 12 likewise takes place via a spray head represented symbolically by a circle, but the container is cleaned via the cleaning lead 57. In this case, the flap 74 is open and the flaps 60 and 58 are closed.

In order to guarantee an optimal throughflow capacity for each tank to be cleaned or each pipeline to be cleaned, there is integrated in the plant the automatically acting throughflow regulation system 73 and quantity counting system, which acts on the frequency-regulated lead pump 40. This specifies precisely the required circuit volume of each individual circuit and sets the optimal cleaning supply pressure at the respective spray head. The computation, design and coordination of pipeline orifices as in the known case are accordingly dispensed with.

The dosing of the cleaning agents lye—connection 23 additive—connection 24 acid—connection 25 disinfecting agent—connection 26 takes place via the dosing station with the associated diaphragm pumps 27, which inject the dosed cleaning agents via the associated regulation valves 28 directly into the central aspiration line 40a of the pump 40, so that only the circuit quantity is primed, and not the entire volume of a storage tank.

In the event that degassing disinfecting agents are used, as has already been described in another context, the complete disinfecting agent line is vented via the valve 75 prior to a dosing.

As may be discerned from FIG. 2 in comparison with the prior art, as a result of the design of only a single supply station for all four cleaning systems of the filling plant it becomes possible to use numerous components in common. These commonalities are:

Only a single fresh water inlet for all four systems is necessary, which inlet even permits a combination of cold/warm water.

The fresh water container 12, the static foot, combines the pipeline system isolator of the filler external cleaning, the lead container of the conveyor CIP cleaning system and the static foot of the filler CIP cleaning.

The pump 40 combines the pressure increasing pump of the filler external cleaning, the lead pump of the conveyor CIP cleaning plant, the lead pump of the filler CIP plant and the lead pump for the hot water flooding in only one unit.

The throughflow meter 73 combines the throughflow measurement of the filler CIP plant, of the conveyor CIP plant and of the hot water flooding in only one function.

The dosing pumps 27 for the foam cleaning are used at the same time for the conveyor CIP cleaning and for the filler external cleaning.

The dosing pump 27 for the disinfecting agent is used at the same time for the conveyor CIP cleaning, the filler external cleaning and the filler CIP cleaning.

Where, in the illustrative embodiment, rotary valve flaps are provided in the circuit, other comparable switching elements may also be provided.

I claim:

1. A plant for cleaning a filling plant having a filler (1) and conveyor (2), which plant comprises a CIP cleaning system (3, 4, 5) for the filler (1) and the conveyor (2) as well as a filler external cleaning system (6, 7) and a hot water flooding system (8, 9), characterized in that for all partial cleaning systems there are provided in a common central cleaning circuit (40*a*, 57) a common supply station (10), comprising the components:
fresh water container (12),
storage container (13–16),
a heating station (29),
a dosing station (27),
which can selectively be connected to and disconnected from the cleaning circuit by means of valves and rotary valve flaps, a programme control system (11), which possesses programme parts both for a sequential and also for a partially parallel activation of the partial cleaning systems, and a common partial line system.

2. A Plant according to claim 1, characterized in that the common central cleaning circuit has a central lead pump (40) having a central suction line (40*a*) and a central cleaning lead line (57) conducted via the heating station (29), in that to the central suction line (40*a*) there are connectable on the one hand the fresh water container (12), which can be supplied alternatively with cold or warm water via a valve arrangement (12*b*), with its lead opening via a rotary valve flap (12*c*), and, on the other hand, the storage containers (13–16) with four stored media lye, hot water, acid and return water with their lead openings in each instance via associated rotary valve flaps (44), a common first suction line (41), a rotary valve flap (47) and a rotary valve flap (48) decoupling the connection of the fresh water container (12) from the storage tanks (13–16), and in that the central cleaning lead line (57) is connectable via a rotary valve flap (59) to the cleaning lead (3*a*) of the filler CIP cleaning, as well as via a rotary valve flap (62) to a collecting line (4) with downstream rotary valve flaps (34) of the CIP cleaning system (4, 5) of the conveyor (2) and via a rotary valve flap (68) to a collecting line (6) with downstream rotary valve flaps (39) of the hot water flooding system.

3. A Plant according to claim 1, characterized in that a second cleaning lead line (66) is provided, which is connectable via a valve (72) to the central cleaning lead line (57) and which is connectable via a rotary valve flap (67) to the collecting line (6) with downstream rotary valve flaps (39) of the filler external cleaning system.

4. A Plant according to claim 1, characterized in that the cleaning return (3*b*) of the filler CIP cleaning is connectable via a rotary valve flap (55) to a third suction line (43), to which the storage inputs of the storage containers (13–16) are connectable in each instance via rotary valve flaps (52, 13*b*–16*b*).

5. A plant according to claim 1, characterized in that a common dosing station (21–27) for cleaning agents and disinfecting agents is provided, which is connectable on the one hand via valves (28) to the central suction line (40*a*) of the pump (40) and on the other hand via valves(70) to the second cleaning lead line (66).

6. A Plant according to claim 1, characterized in that a rotary valve flap switching arrangement (56, 58, 60, 61) is provided, via which a connection is switchable between the central cleaning lead line (57) and the cleaning return (3*b*) of the filler CIP Cleaning.

7. A Plant according to claim 1, characterized in that between the connection of the third suction line (43) with the rotary valve flap (55) to the cleaning return (3*b*) and the connection of the first suction line (41) with the rotary valve flap (47) to the central suction line (40*a*) of the pump (40) there is inserted a second suction line (42), which forms a bypass for the return of the stored media into the storage containers (13–16).

8. A Plant according to claim 1, characterized in that in the hot water flooding mode the second suction line (42) is disconnected via a rotary valve flap (49) and the third suction line (43), which is connected to the second cleaning lead line (57), is activated via the rotary valve flap (55) as well as the rotary valve flap (52, 14*b*), associated with the hot water container (14), to form a circuit for the hot water.

9. A Plant according to claim 1, characterized in that for a self-cleaning of the storage containers (13–16), the second suction line (42) is disconnected via a rotary valve flap (49) and the third suction line (43), which is connected to the central cleaning lead line (57), is activated via the rotary valve flap (55) as well as the rotary valve flap (52), associated with the respective storage container (13–16), and the rotary valve flap **(13*c*–16*c*)** associated with the respective cleaning line.

10. A Plant according to claim 1, characterized in that a leakage rotary valve flap (45) with a downstream drainage outlet (46) is provided for the first suction line (41) and, in the same way, a rotary valve flap (53) with a downstream drainage outlet (54) is provided for the third suction line (43) and a rotary valve flap (50) with a downstream drainage outlet (51) is provided for the second suction line (42).

* * * * *